US005365738A

United States Patent [19]

Etheridge

[11] Patent Number: 5,365,738

[45] Date of Patent: Nov. 22, 1994

[54] LOW EMISSION COMBUSTION NOZZLE FOR USE WITH A GAS TURBINE ENGINE

[75] Inventor: Colin J. Etheridge, Chula Vista, Calif.

[73] Assignee: Solar Turbines Incorporated, San Diego, Calif.

[21] Appl. No.: 829,030

[22] PCT Filed: Dec. 26, 1991

[86] PCT No.: PCT/US91/09554

§ 371 Date: Dec. 26, 1991

§ 102(e) Date: Dec. 26, 1991

[87] PCT Pub. No.: WO93/13359

PCT Pub. Date: Jul. 8, 1993

[51] Int. Cl.[5] ..... F02C 1/00; F02G 3/00

[52] U.S. Cl. ..... 60/742; 60/746; 60/748; 239/126; 239/400

[58] Field of Search ..... 60/39.23, 39.29, 39.463, 60/742, 746, 748; 239/126, 400, 416.4, 416.5

[56] References Cited

U.S. PATENT DOCUMENTS

| | | | |
|---|---|---|---|
| 3,630,024 | 12/1971 | Hopkins | 60/742 |
| 3,691,765 | 9/1972 | Carlisle | 60/742 |
| 3,764,071 | 10/1973 | Carlisle | 60/742 |
| 4,216,652 | 8/1980 | Herman et al. | 60/748 |
| 4,380,895 | 4/1983 | Adkins | 60/39.23 |
| 4,463,568 | 8/1984 | Willis et al. | 60/742 |
| 4,701,124 | 10/1987 | Maghon et al. | 60/746 |
| 4,715,779 | 12/1987 | Suciu | 60/39.07 |
| 4,726,192 | 2/1988 | Willis et al. | 60/748 |
| 4,977,740 | 12/1990 | Madden et al. | 60/39.463 |
| 5,218,824 | 6/1993 | Cederwall et al. | 60/742 |

FOREIGN PATENT DOCUMENTS

| | | | |
|---|---|---|---|
| 0222173A1 | 5/1987 | European Pat. Off. . | |
| 0276696A3 | 8/1988 | European Pat. Off. . | |
| 1114728 | 5/1968 | United Kingdom | 239/400 |
| 2041193A | 9/1980 | United Kingdom . | |

*Primary Examiner*—Richard A. Bertsch
*Assistant Examiner*—Howard R. Richman
*Attorney, Agent, or Firm*—Larry G. Cain

[57] ABSTRACT

Fuel injection nozzles used for reducing NOx in gas turbine engines has incorporated a variety of expensive and complicated techniques. For example, systems use schemes for introducing more air into the primary combustion zone, recirculating cooled exhaust products into the combustion zone and injecting water spray into the combustion zone. The present fuel injector (60,166) reduces the formation of carbon monoxide, unburned hydrocarbons and nitrogen oxides within the combustion zone by controlling the premix air/fuel ratio and more explicitly by controlling the air portion of the air/fuel ratio over the entire operating range of the engine (10). The present fuel injector (60,166) includes a main body assembly (133), a wrapper member (84) being generally coaxially positioned about the main body assembly (133) forming a device (101) for bleeding a portion of the combustion air therefrom, a housing (150) being generally coaxially positioned about the main body assembly (133) and a portion of the wrapper assembly (84) forming an inlet passage (155) between the housing (150) and the wrapper member (84) and an air/fuel premix passage (156) between the housing (150) and the main body assembly (133). The fuel injector (60,166) reduces the flow of compressed air into the combustor (42) by providing the device (101) for bleeding a portion of the flow of compressed air exiting a compressor section (22) within the fuel injector (60,166) and into a combustor (42).

14 Claims, 4 Drawing Sheets

242
12
234
10
238
200
218
236
232
226
230
22
14
20
24
26

200
228
226
224
218
220
222
214
10
12
202
216
208
210
206
204
26
16
18
54
14
22
64
44
48
50
62
42
52
40
60
56
46
28
36
38
30
32
20
24

82
72
70
92
90
92
60
88
74
78
76
78
76
14
16
87
155
158
152
154
150
108
132
144
110
112
138
118
133
130
134
80
94
116
114
120
136
106
107
156
104
85
84
102
100
101
86
160
162
164
50
62

LOW EMISSION COMBUSTION NOZZLE FOR USE WITH A GAS TURBINE ENGINE

DESCRIPTION

1. Technical Field

The present invention relates to a low emission combustion nozzle. More particularly, the invention relates to a combustion nozzle for controlling the combustible air to be mixed with the fuel to control the air to fuel ratio.

2. Background Art

The use of fossil fuel as the combustible fuel in gas turbine engines results in the combustion products of carbon monoxide, carbon dioxide, water vapor, smoke and particulates, unburned hydrocarbons, nitrogen oxides and sulfur oxides. Of these above products, carbon dioxide and water vapor are considered normal and unobjectionable. In most applications, governmental imposed regulation are further restricting the amount of pollutants being emitted in the exhaust gases.

In the past the majority of the products of combustion have been controlled by design modifications. For example, at the present time smoke has normally been controlled by design modifications in the combustor, particulates are normally controlled by traps and filters, and sulfur oxides are normally controlled by the selection of fuels being low in total sulfur. This leaves carbon monoxide, unburned hydrocarbons and nitrogen oxides as the emissions of primary concern in the exhaust gases being emitted from the gas turbine engine.

Oxides of nitrogen are produced in two ways in conventional combustion systems. For example, oxides of nitrogen are formed at high temperatures within the combustion zone by the direct combination of atmospheric nitrogen and oxygen and by the presence of organic nitrogen in the fuel. The rates with which nitrogen oxides form depend upon the flame temperature and, consequently, a small reduction in flame temperature can result in a large reduction in the nitrogen oxides.

Past and some present systems providing means for reducing the maximum temperature in the combustion zone of a gas turbine combustor have included schemes for introducing more air at the primary combustion zone, recirculating cooled exhaust products into the combustion zone and injecting water spray into the combustion zone. An example of such a system is disclosed in U.S. Pat. No. 4,733,527 issued on Mar. 29, 1988 to Harry A. Kidd. The method and apparatus disclosed therein automatically maintains the NOx emissions at a substantially constant level during all ambient conditions and for no load to full load fuel flows. The water/fuel ratio is calculated for a substantially constant level of NOx emissions at the given operating conditions and, knowing the actual fuel flow to the gas turbine, a signal is generated representing the water metering valve position necessary to inject the proper water flow into the combustor to achieve the desired water/fuel ratio.

An injector nozzle used with a water injection system is disclosed in U.S. Pat. No. 4,600,151 issued on Jul. 15, 1986 to Jerome R. Bradley. The injector nozzle disclosed includes an annular shroud means operatively associated with a plurality of sleeve means one inside the other in spaced apart relation. The sleeve means form a liquid fuel-receiving chamber, a water or auxiliary fuel-receiving chamber inside the liquid fuel-receiving chamber for discharging water or auxiliary fuel in addition or alternatively to the liquid fuel, an inner air-receiving chamber for receiving and directing compressor discharge air into the fuel spray cone and/or water or auxiliary fuel to mix therewith from the chamber for receiving and directing other compressor discharge air into the fuel spray cone and/or water or auxiliary fuel from the outside for mixing purposes.

Another example of a fuel injector for a gas turbine engine is disclosed in U.S. Pat. No. 4,463,568 issued on Aug. 7, 1984 to Jeffrey D. Willis et al. In this patent, a dual fuel injector is arranged to maintain pre-determined air fuel ratios in adjacent upstream and downstream opposite handed vortices and to reduce the deposition of carbon on the injector. The injector comprises a central duct, a deflecting member, a first radially directed outlet, and a shroud which defines an annular duct, and a second radially directed outlet. The ducts receive a supply of compressed air and the central duct receives gaseous fuel from an annular nozzle and the annular duct receives liquid fuel from a set of nozzles. When the injector is operating on liquid fuel, the fuel and air mixture issues from the second outlet and compressed air flows from the first outlet and prevents migration of fuel between the two vortices, thereby maintaining a rich air fuel ratio in the upstream vortex which reduces the emissions of NOx. Also, the flow of air from the first outlet reduces the deposition of carbon from the liquid fuels on the deflecting member.

Another fuel injector is disclosed in U.S. Pat. No. 4,327,547 issued May 4, 1982 to Eric Hughes et al. The fuel injector includes means for water injection to reduce NOx emissions, an outer annular gas fuel duct with a venturi section with air purge holes to prevent liquid fuel entering the gas duct. Further included is an inner annular liquid fuel duct having inlets for water and liquid fuel and through which compressor air flows. The inner annular duct terminates in a nozzle, and a central flow passage through which compressed air also flows, terminating in a main diffuser having an inner secondary diffuser. The surfaces of both diffusers are arranged so that their surfaces are washed by the compressed air to reduce or prevent the accretion of carbon to the injector, the diffusers in effect forming a hollow pintle.

Another combustor apparatus for use with a gas turbine engine is disclosed in U.S. Pat. No. 3,906,718 issued on Sep. 23, 1975 to Robert D. Wood. In this patent, a combustion chamber for a gas turbine engine which has staged combustion in two toroidal vortices of opposite hand arranged one upstream of the other is disclosed. A burner delivers air/fuel mixture in a radial direction to support the vortices and the burner has a convergent outlet for the air/fuel mixture.

The above system and nozzles used therewith are examples of attempts to reduce the emissions of oxides of nitrogen. Many of the attempts have resulted in additional expensive components. For example, the Kidd concept requires an additional means for injecting water into the combustion chamber which includes a water source, a control valve, a controlling and monitoring system and a device for injecting water into the combustion chamber.

DISCLOSURE OF THE INVENTION

In one aspect of the invention a fuel injector is comprised of at least one fuel passage, a combustion air inlet passage and means for bleeding or venting a portion of the combustion air from the fuel injector. The combustion air inlet passage being sized so that a sufficient amount of combustion air passes through the fuel injector during operation to support a full load operation.

In another aspect of the invention a fuel injector is comprised of at least one fuel passage through which a combustible fuel passes prior to entering into a combustor during operation of the fuel injector and a combustion air inlet passage being sized so that a sufficient amount of combustion air passes therethrough prior to entering into the combustor, so that during operation, a sufficient amount of combustible fuel is added a full load operation is supported. The fuel injector is further comprised of an annular passage interposed between the combustion air inlet passage and the combustor end and being in fluid communication with the combustion air inlet passage and means for bleeding or venting a portion of the combustion air from the fuel injector.

In another aspect of the invention a fuel injector is comprised of a main body assembly having a combustion end, a second end and an axis and at least one fuel passage through which a combustible fuel is directed. The fuel injector is further comprised of a wrapper member having a first end and a second end. The wrapper member is generally coaxially positioned about the main body assembly and axially extending about a portion of the main body assembly. The wrapper member and the main body assembly forms a means for bleeding therebetween. The fuel injector further includes a housing generally coaxially positioned about the main body assembly and an inlet end being generally coaxially positioned about the second end of the wrapper member. The positioning of the housing relative to the wrapper member forms an inlet passage therebetween and the positioning of the housing relative to the main body assembly forms a combustion air passage therebetween. Each of the means for bleeding and the inlet passage is in fluid communication with the combustion air passage.

The operation of the injector reduces nitrogen oxide, carbon monoxide and unburned hydrocarbon emissions and provides a simple, inexpensive and reliable injection nozzle. The injector used with a system based upon the fact that the rates with which nitrogen oxides form depends upon the flame temperature and, consequently, a small reduction in flame temperature will result in a large reduction in the nitrogen oxides. The injector vents or bleeds compressor air which automatically maintains gas turbine nitrogen oxide, carbon monoxide and unburned hydrocarbon emissions at a specific level during all conditions for no load to full or high load operating parameters.

BEST MODE FOR CARRYING OUT THE INVENTION

Figure 1:
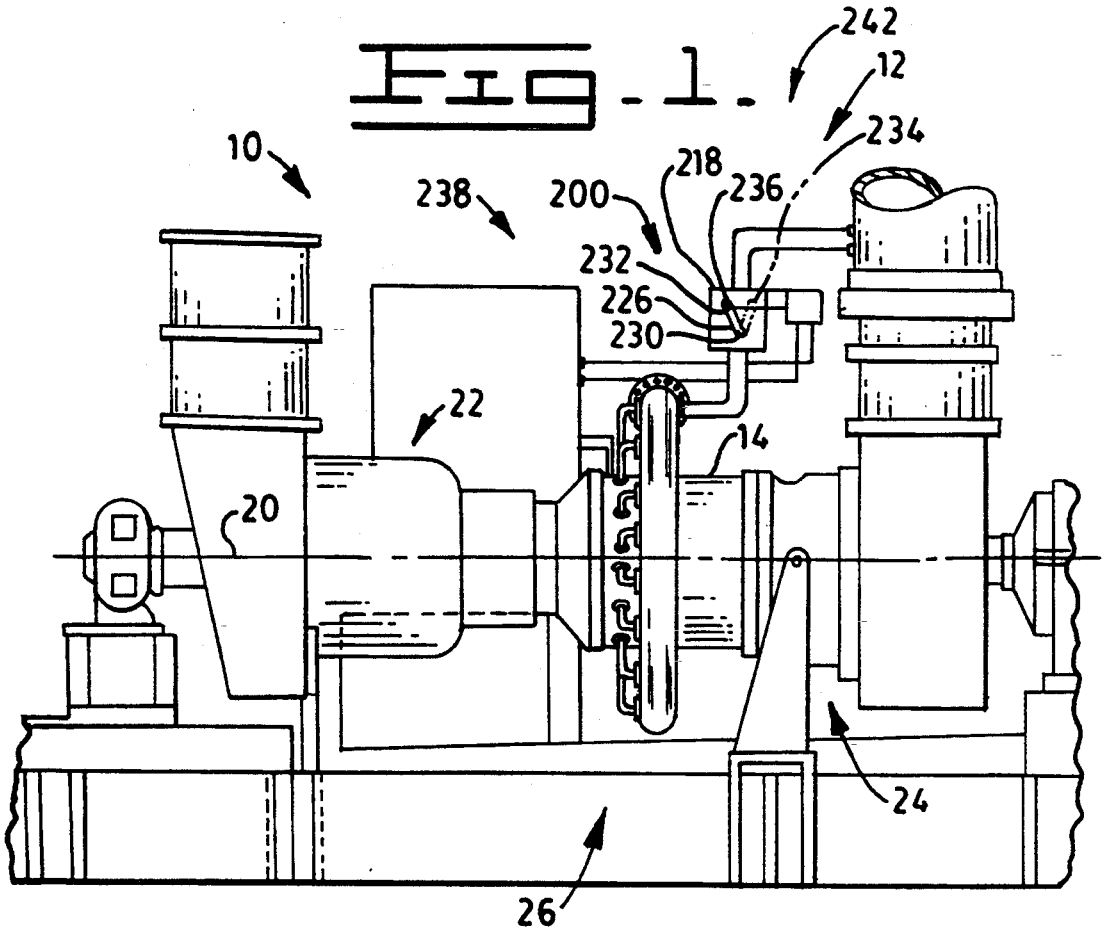
FIG. 1 is an external view of a gas turbine engine and control system having an embodiment of the present invention.
Figure 2:
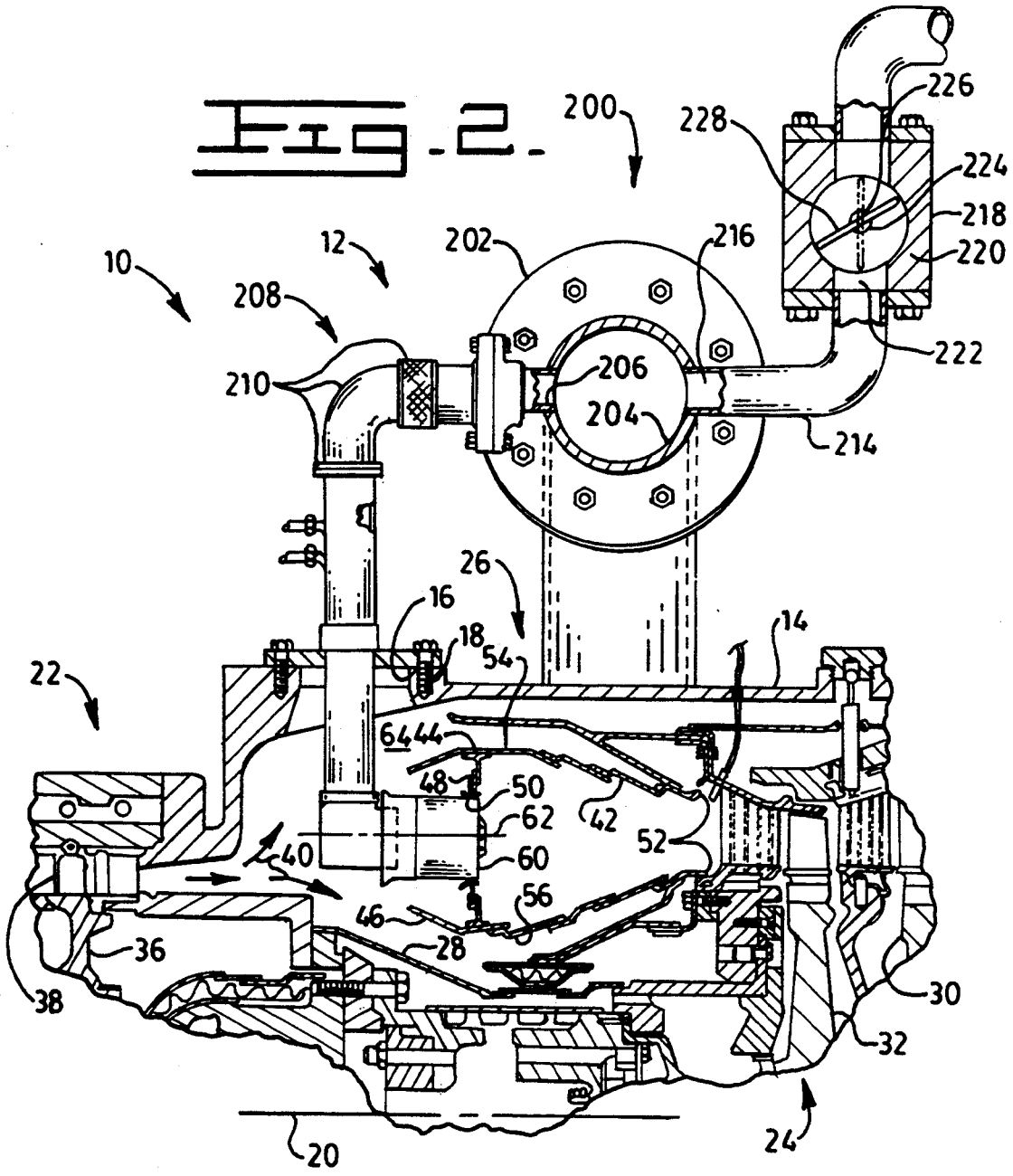
FIG. 2 is a partially sectioned side view of a gas turbine engine having an embodiment of the present invention.

In reference to FIGS. 1 and 2, a gas turbine engine 10 having a control system 12 for reducing nitrogen oxide, carbon monoxide and unburned hydrocarbon emissions therefrom is shown. The gas turbine engine 10 has an outer housing 14 having therein a plurality of openings 16 having preestablished positions and relationship to each other and threaded holes 18 positioned relative to the plurality of openings 16. In this application, the housing 14 further includes a central axis 20 and is positioned about a compressor section 22 centered about the axis 20, a turbine section 24 centered about the axis 20 and a combustor section 26 interposed between the compressor section 22 and the turbine section 24. Functionally, the compressor section or source of compressed air 22 which enters into the combustor section 26 is mixed with a combustible fuel, burns and exits to the turbine section 24. The serial relationship of the compressor section 22, the combustor section 26 and the turbine section 24 must functionally adapt to this order. The engine 10 has an inner case 28 coaxially aligned about the axis 20 and is disposed radially inwardly of the combustor section 26. The turbine section 24 includes a power turbine 30 having an output shaft, not shown, connected thereto for driving an accessory component such as a generator. Another portion of the turbine section 24 includes a gas producer turbine 32 connected in driving relationship to the compressor section 22. The compressor section 22, in this application, includes an axial staged compressor 36 having a plurality of rows of rotor assemblies 38, of which only one is shown. When the engine 10 is operating, a flow of compressed air exits the compressor section designated by the arrows 40. As an alternative, the compressor section 22 could include a radial compressor or any suitable source for producing compressed air.

The combustor section 26 includes an annular combustor 42 being radially spaced a preestablished distance from the housing 14 and being supported from the housing 14 in a conventional manner. The combustor 42 has an annular outer shell 44 being coaxially positioned about the central axis 20, an annular inner shell 46 being positioned radially inwardly of the outer shell 44 and being coaxially positioned about the central axis 20, an inlet end portion 48 having a plurality of generally evenly spaced openings 50 therein and an outlet end portion 52. The outer shell 44 has an outer surface 54 and the inner shell 46 has an outer surface 56 extending generally between the inlet end 48 and the outlet end 52. Each of the openings 50 has an injector 60 having a central axis 62 being generally positioned therein in communication with the inlet end 48 of the combustor 42. The area between the outer housing 14 and the inner case 28 less the area of the annular combustor 42 forms a preestablished cooling area 64 through which a portion of the compressed air will flow. In this application, approximately 20 to 50 percent of the compressed air is used for cooling. As an alternative to the annular combustor 42, a plurality of can type combustors or a side canular combustor could be incorporated without changing the gist of the invention.

Figure 3:
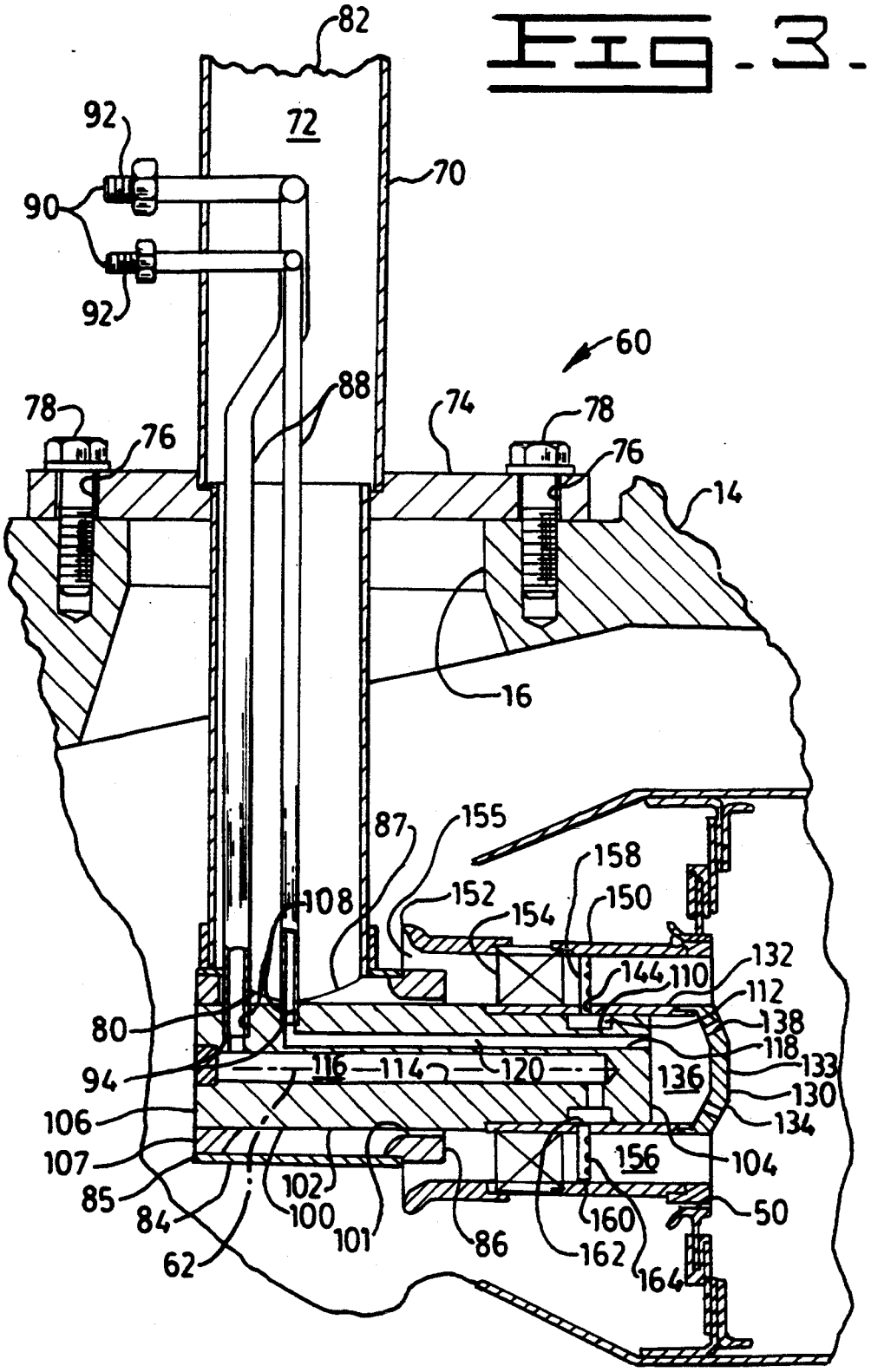
FIG. 3 is an enlarged sectional view of a single fuel injector used in one embodiment of the present invention.

As best shown in FIG. 3, in this application each of the injectors 60 are of the single fuel type and is supported from the housing 14 in a conventional manner. For example, each of the injectors 60 includes a multipiece outer tubular member 70 having a tube passage 72 therein. The tubular member 70 extends radially through one of the plurality of openings 16 in the housing 14 and has a mounting flange 74 extending therefrom. The flange 74 has a plurality of holes 76 therein to receive a plurality of bolts 78 for threadedly attaching within the threaded holes 18 in the housing 14. Thus, the injector 60 is removably attached to the housing 14. The multipiece tubular member 70 further includes a combustor end portion 80 and an exterior end portion 82. The combustor end portion 80 of the tubular member 70 is attached to a wrapper member 84 having a generally tubular configuration, a first end 85 and a second end 86. The tubular member 70 is positioned within an opening 87 within the wrapper member 84 and is fixedly attached thereto. The injector 60 further includes a plurality of fuel delivery tubes 88 positioned within the tube passage 72. Each of the plurality of tubes 88 have a first end 90 sealingly extending through the tubular member 70 and has a threaded fitting 92 fixedly attached thereto for attaching a tube or hose, not shown, for communicating with a source of combustible fuel, either gaseous or liquid. A second end 94 of each of the plurality of tubes 88 is attached to a generally cylindrical main body 100 having an axis coinciding with the axis 62 of the injector 60 and a portion thereof coaxially positioned within the wrapper member 84. A means for bleeding or venting having a preestablished clearance or orifice 101 having a preestablished cross-sectional area is formed between the wrapper member 84 and the main body 100. The main body 100 has a stepped outer surface 102, a first end 104 and a second end 106. The second end 106 of the main body 100 and the first end 85 of the wrapper member 84 are sealingly attached by a ring 107 interposed therebetween. A plurality of stepped bores 108 are positioned near the second end 106 and extend from the outer surface 102 into the main body 100 a predetermined depth. The second end 94 of the corresponding tube 88 is positioned within the corresponding stepped bore 108 and is fixedly attached thereto such as by welding. A first annular groove 110 is positioned near the first end 104 and extends radially inward from the outer surface 102 a predetermined depth forming a main gaseous fuel reservoir 112. A first bore 114 extending a predetermined depth from the second end 106 axially through the main body 100 and connects with the first annular groove 110 and one of the stepped bores 108. An end of the first bore 114 at the second end 106 of the main body 100 is sealing closed forming a portion of a gaseous fuel passage 116 interconnecting the first annular groove 110 with the proper one of the tubes 88. A second bore 118 extending a predetermined depth from the first end 104 axially through the main body 100 and connects with one of the stepped bores 108 forming a portion of a pilot fuel passage 120. A cap member 130 includes a cylindrical portion 132 positioned about the outer surface 102 and is fixedly attached to the main body 100 near the first end 104 forming a main body assembly 133. A combustor end 134 of the cap member 130 is axially spaced a preestablished distance from the first end 104 of the main body 100 forming a gaseous pilot reservoir 136 within the cap member 130. The combustor end 134 has a plurality of holes 138 therein being in fluid communication with the gaseous pilot reservoir 136. The gaseous pilot reservoir 136 is in fluid communication with the pilot fuel passage 120, the proper one of the tubes 88 and a source of gaseous fuel, not shown. Each of the plurality of holes 138 is positioned on a base circle, not shown, having a preestablished radius about the axis 62 of the injector 60 and the main body 100. Each of the plurality of holes 138 is angled obliquely with respect to the axis 62 of the main body 100. A first set of radial holes 144 for a low emissions gaseous fuel injection mode are defined within the cylindrical portion 132 and are spaced evenly therearound. The first set of holes 144 are axially spaced from the first end 104 of the main body 100 and are axially aligned with the main gaseous fuel reservoir 112. The gaseous fuel reservoir 112 is in fluid communication with the source of gaseous fuel by way of the gaseous fuel passage 116 and the corresponding tube 88.

The injector 60 further includes a multipiece housing 150 having a generally cylindrical configuration being positioned coaxially about a portion of the main body 100 and having a flared air inlet end 152. The air inlet end 152 is generally coaxially positioned about the second end 86 of the wrapper member 84 and is supported from the main body assembly 133 by a plurality of swirler vanes 154. An inlet passage 155 having a preestablished cross-sectional area is formed between the housing 150 and the wrapper member 84. Approximately 50 to 80 percent of the compressed air enters into the inlet passage 155. All air used to support combustion passes through the inlet passage 155 prior to entering into the combustor 42. The plurality of swirler vanes 154 are interposed between the housing 150 and the main body assembly 133 radially positioning the housing 150 relative to the cap member 130. The plurality of swirler vanes 154 are axially spaced between the first set of holes 144 and the second end 106 of the main body 100. An air/fuel premix passage 156 having a preestablished area through which a portion of the compressed air can flow is formed between the housing 150 and the main body assembly 133. In this application, depending on the engine 10 operating parameters, approximately 60 to 100 percent of the compressed air passing through the inlet passage 155 enters into the air/fuel premix passage 156. The flow of compressed air through the air/fuel premix passage 156 into the combustor 42 is an amount sufficient, with the addition of an appropriate amount of fuel, to support full load operation of the gas turbine engine 10. Furthermore, in this application the preestablished cross sectional area of the orifice 101 is sized so that approximately 5 to 45 percent of the flow of compressed air exiting the inlet passage 155 pass through the orifice 101. The air/fuel premix passage 156 is in fluid communication with the tube passage 72 within the tubular member 70 by way of the preestablished orifice 101 formed between the wrapper member 84 and the main body 100. A plurality of hollow spokes 158 are sealingly positioned in corresponding ones of the first set of holes 144. Each of the spoke members 158 have a preestablished length, a first end 160 which is closed and a second end 162 which is open. A plurality of passages 164 are axially spaced there along each of the spoke members 158 and are in fluid communication with the hollow portion of each of the spoke members 158 and the main gaseous fuel reservoir 112. The plurality of passages 164 are positioned in such a manner so as to direct a flow of gaseous fuel into the flow of compressed air exiting the plurality of swirler vanes 154 in a manner most efficient to premix the air and the fuel.

Figure 4:
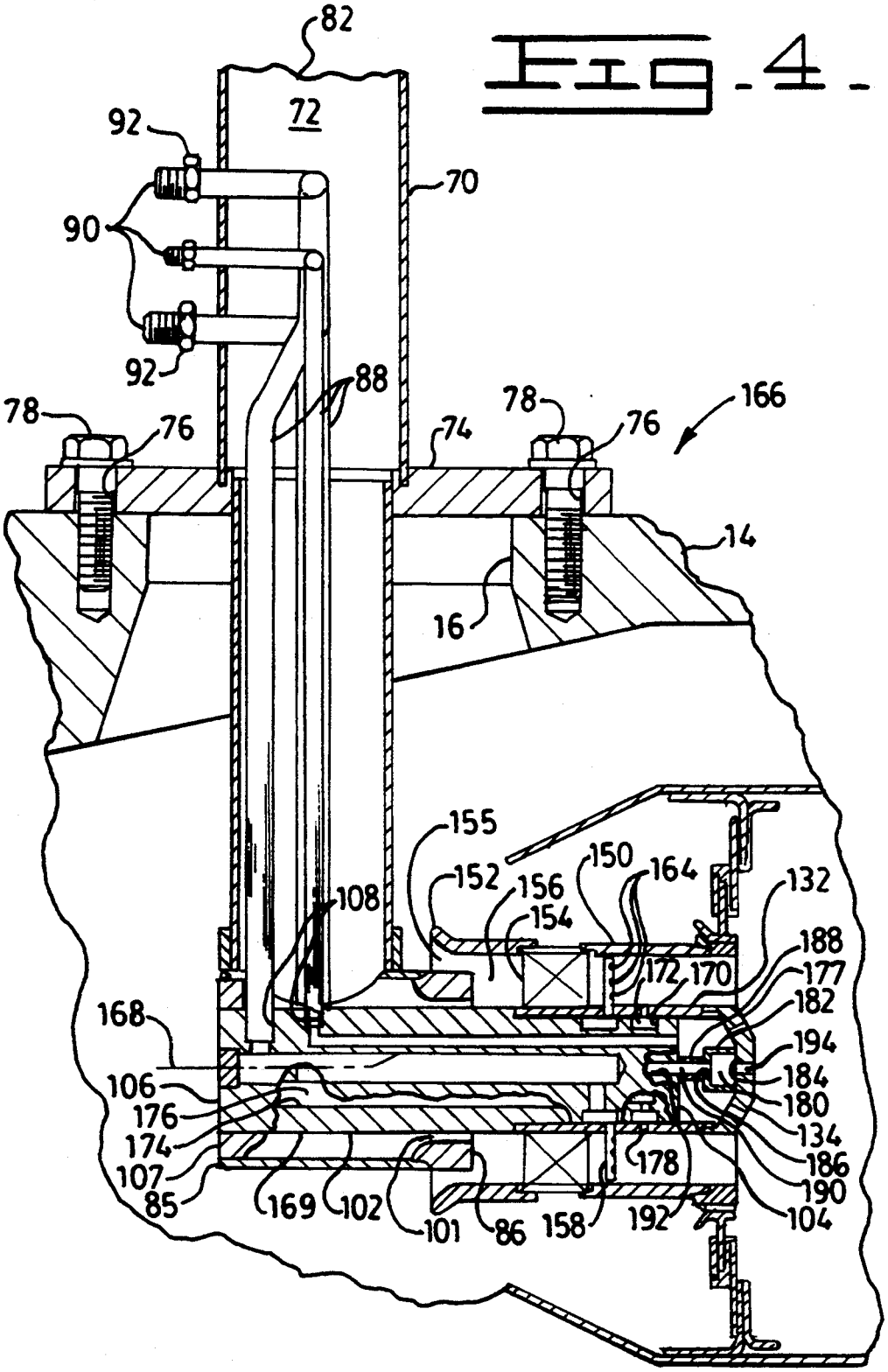
FIG. 4 is an enlarged sectional view of an alternate embodiment of a dual fuel injector used in one embodiment of the present invention.

As an alternative and best shown in FIG. 4, the injectors 60 could be of the dual fuel type. It is noted that the same reference numerals of the first embodiment, the single fuel injection nozzle, are used to designate similarly constructed counterpart elements of this embodiment. For example, a dual fuel injector 166 has a central axis 168 and is supported from the housing 14 in a conventional manner. For example, each of the injectors 166 include a generally cylindrical main body 169, the counterpart elements defined earlier for the generally cylindrical main body 100 of the single fuel injection nozzle 60. The cylindrical main body 169 of the dual fuel injector 166 has an axis thereof coinciding with the axis 168 of the injector 166 and a portion thereof coaxially positioned within the wrapper member 84. A second annular groove 170 is axially spaced from the first annular groove 110, positioned intermediate the first annular groove 110 and the first end 104 and extends radially inward from the outer surface 102 a predetermined depth forming a main liquid fuel reservoir 172. A third bore 174 extends a predetermined depth from the second end 106 axially through the main body 169 and connects with the second annular groove 170 and one of the stepped bores 108. An end of the third bore 174 at the second end 106 of the main body 169 is sealingly closed forming a portion of a liquid fuel passage 176 interconnecting the second annular groove 170 with the proper one of the tubes 88. A cap member 177 for the dual fuel injector 166 includes the counterpart elements defined earlier for the cap member 130 of the single fuel injection nozzle 60. The cap member 177 includes the cylindrical portion 132 positioned about the outer surface 102 and is fixedly attached to the main body 169 near the first end 104 forming the main body assembly 133. A second set of radial holes 178 for a low emissions liquid fuel injection mode are defined within the cylindrical portion 132 and are spaced evenly therearound. The second set of holes 178 are axially spaced from the first end 104 of the main body 169 and are axially aligned with the main liquid fuel reservoir 172. The liquid fuel within the main liquid fuel reservoir 172 is in fluid communication with a source of liquid fuel by way of the liquid fuel passage 176 and the corresponding tube 88. Thus, the liquid fuel exiting the second set of holes 178 are in fluid communication with the air within the air/fuel premix passage 156 and further exits into the combustor 42.

The dual fuel type injector 166 further includes a liquid pilot reservoir 180 formed within the cap member 177. A generally cup shaped member 182 is sealing attached to an inside surface 184 of the combustor end 134 and has an opening 186 therein. A liquid pilot fuel tube 188 having a liquid fuel passage 190 therein has one end sealingly attached to the cup shaped member 182 and communicates with a liquid fuel source, not shown and the liquid pilot reservoir 180. One end of the liquid pilot fuel tube 188 extends through the cup shaped member 177 and is sealingly attached thereto and another end is sealingly attached to the main body 169. A fourth bore 192 extends axially through the main body 169 and is in fluid communication with the liquid passage 190. The fourth bore 192 connects with one of the stepped bores 108 and is sealingly closed near the second end 106 forming a portion of the liquid fuel passage 190. An opening 194 is positioned coaxially with the axis 168 in the combustor end 134 of the cap member 177 and communicates with the liquid pilot reservoir 180 and the combustor 42.

The control system 12 for reducing nitrogen oxide, carbon monoxide and unburned hydrocarbon emissions from the gas turbine engine 10 includes means 200 for directing a portion of the flow of compressed air exiting the compressor section 22 through the injector 60,166 into the inlet end 48 of the combustor 42. The means 200 for directing a portion of the flow of compressed air includes the outer housing 14, the outer shell 44, the inlet end 48 and the inner shell 46 of the combustor section 26. The preestablished spaced relationship of the outer and inner shells 44,46 of the combustor 42 to the outer housing 14 and the inner case 28 which forms the preestablished flow areas between the combustor 42, and the outer housing 14 and the inner case 26 is also a part of the means 200.

As best shown in FIGS. 1 and 2, the control system 12 for reducing nitrogen oxide, carbon monoxide and unburned hydrocarbon emissions from the engine 10 further includes a manifold 202 having a manifold passage 204 therein. The manifold 202 is positioned externally of the outer housing 14 and encircles the outer housing 14. A plurality of openings 206 in the manifold correspond in location to the location of each of the tubular members 70. The tubular members 70 form a part of a means 208 for ducting and are in attached communication with the plurality of openings 206 in the manifold 202. Thus, the manifold passage 204 within the manifold 202 is in fluid communication with compressed air inside the tube passage 72 of the tubular member 70. The means 208 for ducting includes a plurality of elbows, flanges and connectors 210. The manifold 202 further includes an outlet opening 212 having a duct 214 attached thereto. The duct 214 has a duct passage 216 therein which is in fluid communication with the manifold passage 204. Attached to the duct 214 is a valve 218. In this application, the valve 218 is of the conventional butterfly type but could be of any conventional design. The valve 218 includes a housing 220 having a passage 222 therein. Further included in the housing 220 is a through bore 224 and a pair of bearings, not shown, are secured in the bore 224. A shaft 226 is rotatably positioned within the bearings and has a throttling mechanism 228 attached thereto and positioned within the passage 222. The shaft 226 has a first end 230 extending externally of the housing 220. A lever 232 is attached to the first end 230 of the shaft 226 and movement of the lever 232 causes the throttling mechanism 228 to move between a closed position 234 and an open position 236.

Further included with the control system 12 for reducing nitrogen oxide, carbon monoxide and unburned hydrocarbon emissions is means 238 for controllably reducing the amount of air directed into the combustor 42 and means 242 for monitoring and controlling the portion of the flow of compressed air bleed from the injector 60,166.

INDUSTRIAL APPLICABILITY

In use the gas turbine engine 10 is started and allowed to warm up and is used to produce either electrical power, pump gas, turn a mechanical drive unit or another application. As the demand for load or power produced by the generator is increased, the load on the engine 10 is increased and the control system 12 for reducing nitrogen oxide, carbon monoxide and unburned hydrocarbon emission is activated. In the start-up and warm up condition, the throttling mechanism 228 of the valve 218 is positioned in either the partly open 236 or closed 234 position and the minimum amount of compressed air is bled from the injector 60,166 and the maximum amount of compressed air enters the combustor 42. During the start and warm up condition the engine is in a high emissions mode and uses only pilot fuel. For example, the compressed air from the compressor section 26 flows between the outer housing 14 and the inner case 28 toward the inlet end 48 of the combustor 42 wherein a portion of the compressed air flows through the preestablished cooling area 64 formed between the outer housing 14 and the inner case 28 less the area of the combustor 42. The remainder of the air flows through the inlet 155 having the preestablished cross-sectional area formed between the housing 150 and the main body 100,169. At a particular minimum power level, the throttle mechanism 228 opens to attain a particular primary zone fuel air ratio in the combustor 42 and the fuel is then transferred to the gaseous or liquid main circuit thereby going into a low emission mode. With the throttling mechanism 228 in the required open position 236, the maximum allowable flow of compressed air is directed through the path of least resistance by way of the means for bleeding or venting or clearance 101. This minimizes the amount of air directed through the preestablished area of the air/fuel premix passage 156 to the combustor 42. Thus, the fuel/air ratio and the temperature within the combustor 42 is controlled and the formation of nitrogen oxide, carbon monoxide and unburned hydrocarbon is minimized. As the the load on the engine 10 is increased, the amount of fuel injected into the combustor section 26 is increased, the fuel/air ratio changes and the combustion temperature within the combustor section 26 is increased. The results of the increase of combustion temperatures causes the temperature of the gases at the power turbine 30 inlet to increase. To reduce these temperatures, the throttling mechanism 228 to move toward the closed position 234. This reduces the amount of air bled or vented from the nozzle and increases the amount of air directed to the combustor 42. In order to accelerate, the air/fuel ratio must change. In the air/fuel ratio, the relationship of the amount of fuel increases whereas the air remains constant. However, to control the temperature of combustion and the would be resulting increased emissions of nitrogen oxide, carbon monoxide and unburned hydrocarbon during combustion temperatures of generally between about 2700 to 3140 degrees Fahrenheit the air bleed valve 218 moves according. The temperature of the gases entering into the turbine section 24 is monitored frequently and the controls operate to maintain the 2700 to 3140 degrees Fahrenheit level. Thus, the emissions are controlled over the entire operating range of the engine 10. As the engine 10 continues to accelerates to the full load condition without an bleed or venting, thereby maintaining the low emission level.

Other aspects, objectives and advantages of this invention can be obtained from a study of the drawings, the disclosure and the appended claims.

I claim:

1. A fuel injector (60,166); comprising:

a main body assembly (133) having a combustor end (134), a second end (106) and an axis (62) and at least one fuel passage (116,120,176,190) through which a combustible fuel is directed;

a wrapper member (84) having a first end (85) and a second end (86), being generally coaxially positioned about said main body assembly (133), said wrapper member (84) axially extending about a portion of the main body assembly (133) and said wrapper member (84) and said main body assembly (133) forming a means for bleeding (101) therebetween;

a housing (150) being generally coaxially positioned about the main body assembly (133) and an inlet end (152) being generally coaxially positioned about the second end (86) of the wrapper member (84), said positioning of said housing (150) relative to said wrapper member (84) forming an inlet passage (155) therebetween and said positioning of said housing (150) relative to said main body assembly (133) forming an air/fuel premix passage (156) therebetween; and each of said means for bleeding (101) and said inlet passage (155) being in fluid communication with the air/fuel premix passage (156).

2. The fuel injector (60,166) of claim 1 wherein said main body assembly (133) includes a gaseous pilot fuel passage (120) partially axially extending therethrough and exiting into a gaseous pilot fuel reservoir (136) having a plurality of holes (138) exiting therefrom and a gaseous fuel passage (116) partially axially extending therethrough and exiting into a main gaseous fuel reservoir (112) having a plurality of hollow spoke members (158) in communication therewith through which during operation of the fuel injector (60,166) a gaseous fuel exits therefrom.

3. The fuel injector (60,166) of claim 2 wherein said plurality of hollow spoke members (158) are interposed between the inlet end (152) of the housing (150) and the combustor end (132) of the main body assembly (133) and extend into said air/fuel premix passage (156).

4. The fuel injector (60,166) of claim 3 wherein said plurality of hollow spoke members (158) being positioned evenly around the main body assembly (133) and each having a plurality of passages (164) axially spaced there along and said plurality of passages (164) being positioned is such a manner so as to face generally toward the combustor end (132) of the main body assembly (133).

5. The fuel injector (60,166) of claim 3 further including a plurality of swirlers axially spaced between the hollow spoke members (158) and the inlet end (152) of the housing, said plurality of swirlers being interposed between the housing (150) and the main body assembly (133) supporting the housing relative to the main body assembly (133).

6. The fuel injector (60,166) of claim 1 wherein said second end (106) of said main body assembly (133) and said first end (85) of said wrapper member (84) are sealingly attached and said wrapper member (84) further includes an opening (87) being in fluid communication with said means for bleeding (101).

7. The fuel injector (60,166) of claim 6 wherein said opening (87) is in fluid communication with said inlet passage (155) formed between the housing (150) and the wrapper member (84).

8. The fuel injector (60,166) of claim 1 wherein said main body assembly (133) further includes a pilot liquid fuel passage (190) partially axially extending therethrough and exiting into a liquid pilot fuel reservoir (180) and a liquid fuel passage (176) partially axially extending therethrough and exiting into a main liquid fuel reservoir (172) having a set of radial holes (178) in communication therewith through which during operation of the fuel injector (60,166) a liquid fuel exits therefrom.

9. The fuel injector (60,166) of claim 8 wherein said set of radial holes (178) being positioned evenly therearound the main body assembly (133) and being positioned intermediate the combustor end (134) and a plurality of hollow spoke members (158), said plurality of spoke members (158) being positioned axially from the combustor end (134).

10. The fuel injector (60,166) of claim 9 wherein said plurality of hollow spoke members (158) are interposed between the inlet end (152) of the housing (150) and the combustor end (134) of the main body assembly (133) and extend into said air/fuel premix passage (156).

11. The fuel injector (60,166) of claim 10 wherein said plurality of hollow spoke members (158) being positioned evenly around the main body assembly (133) and each having a plurality of passages (164) axially spaced there along and said plurality of passages (164) being positioned is such a manner so as to face generally toward the combustor end (134) of the main body assembly (133).

12. The fuel injector (60,166) of claim 10 further including a plurality of swirlers axially spaced between the hollow spoke members (158) and the inlet end (152) of the housing, said plurality of swirlers being interposed between the housing (150) and the main body assembly (133) supporting the housing relative to the main body assembly (133).

13. The fuel injector (60,166) of claim 8 wherein said second end (106) of said main body assembly (133) and said first end (85) of said wrapper member (84) are sealingly attached and said wrapper member (84) further includes an opening (87) being in fluid communication with said means for bleeding (101).

14. The fuel injector (60,166) of claim 13 wherein said opening (87) is in fluid communication with said inlet passage (155) formed between the housing (150) and the wrapper member (84).

* * * * *